US010255848B2

(12) United States Patent
Komanduri et al.

(10) Patent No.: US 10,255,848 B2
(45) Date of Patent: Apr. 9, 2019

(54) SIMULTANEOUS DISPLAY AND LIGHTING

(71) Applicant: ABL IP Holding LLC, Conyers, GA (US)

(72) Inventors: Ravi Kumar Komanduri, Brambleton, VA (US); David P. Ramer, Reston, VA (US); Guan-Bo Lin, Reston, VA (US)

(73) Assignee: ABL IP Holding LLC, Conyers, GA (US)

( * ) Notice: Subject to any disclaimer, the term of this patent is extended or adjusted under 35 U.S.C. 154(b) by 0 days.

(21) Appl. No.: 15/467,333

(22) Filed: Mar. 23, 2017

(65) Prior Publication Data

US 2018/0277035 A1 Sep. 27, 2018

(51) Int. Cl.
*G09G 3/32* (2016.01)
*G09G 3/34* (2006.01)

(52) U.S. Cl.
CPC ..... *G09G 3/32* (2013.01); *G09G 3/348* (2013.01); *G09G 2320/0633* (2013.01); *G09G 2320/0646* (2013.01)

(58) Field of Classification Search
CPC combination set(s) only.
See application file for complete search history.

(56) References Cited

U.S. PATENT DOCUMENTS

2011/0215725 A1* 9/2011 Paolini ..... H05B 33/086 315/153
2017/0059151 A1* 3/2017 Black ..... F21V 33/0052
2017/0061904 A1* 3/2017 Lin ..... G09G 3/3426
2017/0061905 A1* 3/2017 Lin ..... G09G 3/3426
2017/0076677 A1* 3/2017 Lin ..... G09G 3/3426
2018/0005590 A1* 1/2018 Komanduri ..... H05B 37/0272
2018/0018749 A1* 1/2018 Goodman ..... G06T 1/20

OTHER PUBLICATIONS

Fraunhofer-Gesellschaft, Sky light sky bright-in the office, Research News, Jan. 2012—Topic 1. Retrieved rom http://www.fraunhofer.de/en/press/research-news/2012/january/sky-light-sky-bright.html, dated Jan. 2, 2012, 2 pages.

Matthias Bues et al., "Convergence and Display: Opportunities, Requirements, Challenges", Fraunhofer Institute for Industrial Engineering (IAO), Stuttgart, Germany, SID 2016 Digest,ISSN0097-966X/16/4701-0110-$1.00 © 2016 SID, pp. 110-113, 4 pages.

* cited by examiner

*Primary Examiner* — Kenneth Bukowski
(74) *Attorney, Agent, or Firm* — RatnerPrestia

(57) ABSTRACT

The examples relate to various implementations to enable simultaneous controllable lighting distribution and a wide angle image light output from areas of a luminaire. An example of such a luminaire includes image light emitters and an array of general illumination light emitters for general illumination. A grid structure that has a supporting grid of rows and columns with intersection points and transparent sections or gaps is used to maintain a spaced arrangement of the general illumination light emitters and the image light emitters. Each of the transparent sections is bounded by individual structural members of the grid meeting at individual intersection points. In a specific example, image light emitters are located at intersection points of the grid structure. The general illumination light emitters are optically coupled for emitting general illumination light through the transparent sections of the grid.

23 Claims, 6 Drawing Sheets

SIMULTANEOUS DISPLAY AND LIGHTING

TECHNICAL FIELD

The present subject matter relates to techniques for simultaneously presenting an image on a display device and outputting general illumination lighting, for example, having a fixed or controllable illumination distribution.

BACKGROUND

Display devices have become ubiquitous in the present day. In addition to the obvious television and computer monitor implementations, display devices are present in home appliances, smart phones, billboards, stadium scoreboards, fast food restaurant menu boards, children's toys and the like. The intent usually is to deliver more content, e.g., movies, videos, pictures, graphics and the like, to users at as high of a resolution as possible.

Lighting fixtures and displays have fundamentally different requirements for consumer applications. Typically, the lighting and display functions for simultaneous capability have been separated into different fixtures.

Image displays that use liquid crystals (LC) as an element of the display usually suffer high optical losses. For example, the final light output is usually less than 10% of what was originally produced by the general illumination light emitters. This reduces the efficiency of an image display to the extent that the display's illumination efficiency cannot compare with standard luminaire efficiencies which are in the range of 100 lumens/watt. In fact, most LCD based image displays cannot perform better than 10 lumens/watt. In other words, the general illumination performance of a conventional LCD based image display does not satisfy minimal lighting requirements set by building codes or industry standards, such as Illuminating Engineering Society (IES) and American National Standards Institute (ANSI) standards. Other display technologies, such as projection displays, LED-LCD or plasma displays are optimized for the display function and offer poor illumination efficiency, and thus are similarly unsuited to general lighting. In addition, many displays usually use combinations of narrow bandwidth emitters as the sources, therefore the light output is not spectrally filled as one would expect from a typical white light luminaire. This directly relates to metrics such as CRI and R9. As a result, an image display alone is a poor substitute for a standard luminaire regardless of the type of image display (e.g., LCD, Plasma, LED or the like).

SUMMARY

Hence, there is room for further improvement in lighting devices that also provide image display functions.

The examples described herein include a luminaire. The luminaire includes walls formed by structural members that meet at individual grid structure intersection points. The walls form a perimeter of individual transparent sections. A luminaire also includes number of general illumination light emitters. Each of the general illumination light emitters may be positioned to output general illumination light toward a corresponding individual transparent section. The luminaire also has a number of transparent optical couplings. Each optical coupling has an optical input interface and an optical output interface. The optical input interface may be positioned to receive light from a respective one of the general illumination light emitters. The optical output interface is opposite the optical input interface, and may be configured to output general illumination light received from a respective general illumination light emitter through the individual transparent section corresponding to the respective general illumination light emitter. Each optical coupling is configured to direct general illumination light emitted via the optical output interface in a narrow beam shape having a first light distribution angle. The luminaire also has a number of image light emitters. Each image light emitter is located at one of the individual grid structure intersection points, and may be configured to emit image light forming a pixel of an image. The image light output in a wide beam shape having a second light distribution angle. In an example, the second light distribution angle is greater than the first light distribution angle.

Another example of a luminaire includes a set of general illumination light sources, a set of image light emitters, and a grid structure. The set of general illumination light sources emit general illumination light for illuminating a space. Each general illumination light source in the set of general illumination light sources includes a general illumination light emitter, and a transparent optical coupling. The general illumination light emitter has an output surface. The general illumination light emitter outputs general illumination light from the output surface. The transparent optical coupling collimates the general illumination light output from the output surface of the general illumination light emitter. The transparent optical coupling has an optical output interface that is aligned along a center axis with the output surface of the general illumination light emitter. The general illumination light output via the optical output interface has a general illumination light distribution according to a predetermined beam shape and beam direction. Each of the image light emitters in the set of image light emitters may be configured to emit image light from an image light emitter output. The emitted image light from each image light emitter has an image light distribution that overlaps image light emitted by an adjacent image light emitter to display an image. The image light distribution is wider than the general illumination light distribution. The grid structure is configured to maintain the general illumination light sources and the image light emitters in a spaced arrangement relative one another. The luminaire is configured to display the image and emit general illumination light simultaneously from the grid structure.

An example of a lighting device is provided. The lighting device includes a luminaire and a host processing system. The luminaire provides configurable illumination of a space and for displaying an image in the space. The luminaire includes an array of general illumination light emitters, a number of transparent optical couplings, an array of image light emitters, and a grid structure. The array of general illumination light emitters may be controllable to emit general illumination light for illuminating the space. Each of the general light emitters has an output. Each respective transparent optical coupling of the plurality of transparent optical couplings has an optical output interface, and may be coupled to the output of a corresponding one of the general illumination light emitters to output general illumination light received from the corresponding general illumination light emitter for output through the optical output interface. The array of image light emitters may be configured to display the image. Each of the image light emitters in the array may be controllable to emit image light for a respective pixel of the image. The grid structure is configured to maintain a spaced arrangement of general illumination light emitters of the array of general illumination light emitters and the image light emitters of the array of image light emitters. A host processing system may be coupled to the array of general illumination light emitters and the array of image light emitters. The host processing system may include a processor and a memory coupled for access by the processor. The memory stores program instructions for controlling illumination and display operations of the lighting device and a configuration file. The configuration file may contain general illumination configuration data for controlling the emitted general illumination light. The processor when executing the program instructions stored in the memory, configures the host processing system to perform functions. The host processing system may obtain image data and control the array of image light emitters to display the image, based on the obtained image data. The host processing system also accesses the general illumination configuration data in the configuration file. The host processing system may configure the array of general illumination light emitters to emit general illumination light based on the general illumination configuration data, while a portion of or all of the number of image light emitters of the luminaire displays the image.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

This application relates to techniques to enable simultaneous lighting with a first output distribution and a wide angle display light output through the same output area of a lighting device. An example of such a configurable luminaire includes an emissive display and an array of emitters for illumination. The image display in the example is effectively transmissive with respect to the general illumination light. The image display in most of the examples uses a grid arrangement, which has a supporting grid of rows and columns with intersection points and transparent sections. Each of the transparent sections is bounded by individual structural members of the grid meeting at individual intersection points. In a specific example, image light emitters are mounted at intersection points of the grid structure. The illumination light emitters are coupled, e.g. by TIR lenses to the transparent sections of the grid structure so that general illumination light may be transmitted through the transparent sections. In this application, these two functions of illumination and display are separated by angle, where the illumination, for example, may be distributed in a narrow angle while the displayed image is viewed at higher angles.

Reference now is made in detail to the examples illustrated in the accompanying drawings and discussed below.

Figure 1:
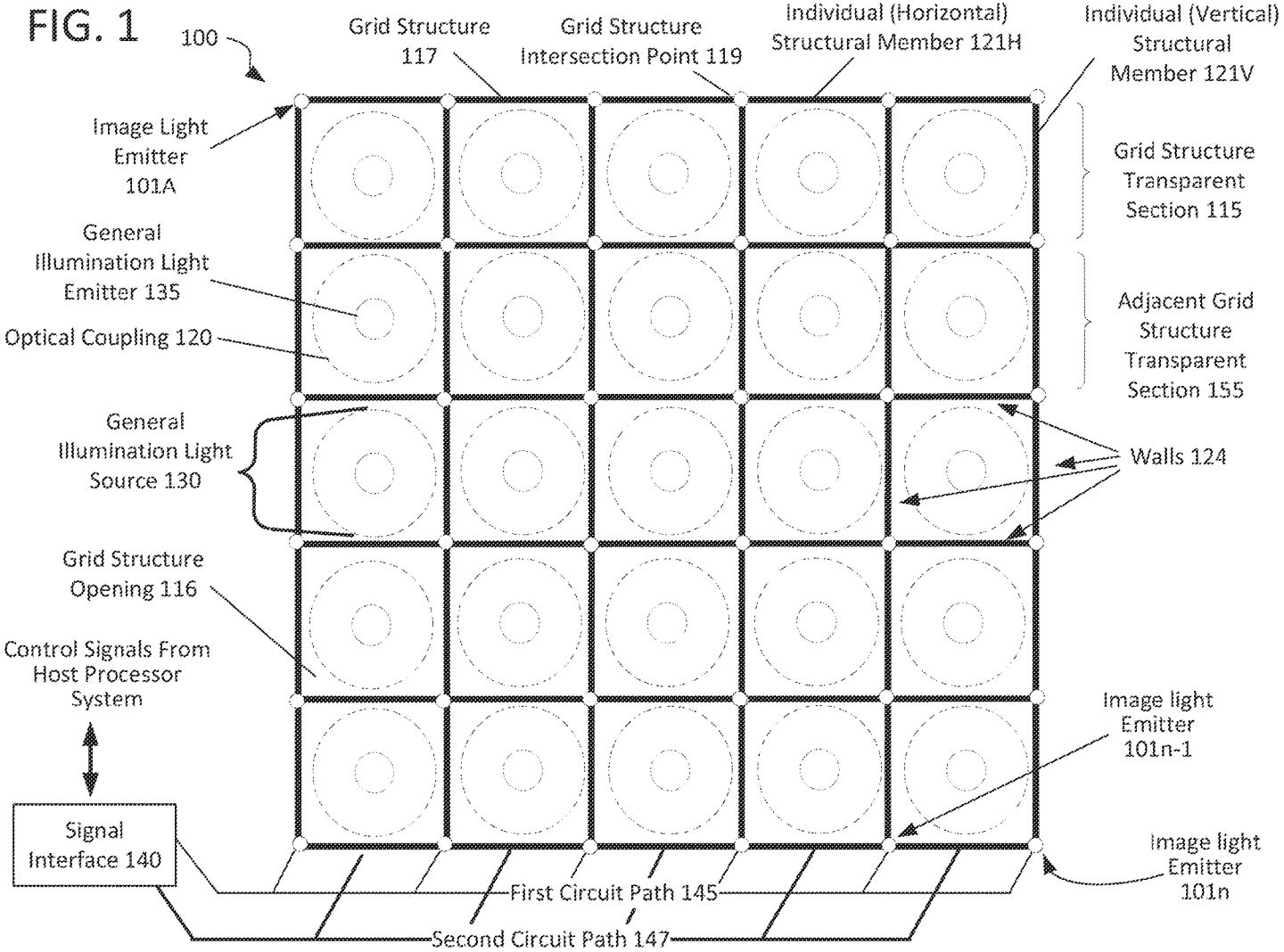
FIG. 1 illustrates an example of a luminaire for providing general illumination lighting and presentation of an image.

FIG. 1 illustrates an example of a luminaire 100 for providing general illumination lighting and presentation of an image simultaneously from a grid structure 117. As shown in FIG. 1, the luminaire 100 includes the grid structure 117, a number of general illumination light sources 130, and a number image light emitters 101A-n. Each of the general illumination light sources 130 includes a general illumination light emitter 135 and an optical coupling 120. The luminaire 100 is also coupled to a signal interface 140 via a first circuit path 145 and a second signal path 147. The general illumination light sources 130 including the general illumination light emitters 135 may, for example, be responsive to drive or control signals received via the first circuit path 145 from a host processor system (shown in other examples). Similarly, the image light emitters 101A-n may, for example, be responsive to drive or control signals received the second circuit path 147 from the host processor system.

The grid structure 117 in this example is configured to maintain the general illumination light sources 130 and the image light emitters 101A-n in a spaced arrangement relative one another. The grid structure 117 shown includes a supporting grid of rows and columns with intersection points 119 and transparent sections 115. Each of the transparent sections 115 may bounded by walls 124 of individual structural members, such as 121H and 121V, of the grid 117 meeting at the individual intersection points 119. The transparent sections 115 are provided to allow light to pass through the grid structure 117 but may also formed of a transparent material that helps to prevent dust and/or dirt from entering the luminaire 100. Of course, the transparent sections may be hollow 100 without any, or only a limited amount of, transparent material present.

While the grid structure 117 in this example is shown in a pattern made up of a number of adjacent squares, other grid structure arrangements or patterns may be used, such as, for example, a pattern of squares, diamonds, triangles, a honeycomb pattern made of hexagonal shapes or the like. For example, the grid structure 117 may be configured to have individual structural members in the form of circles. In such an arrangement, the circles may contain the general illumination light sources 130, and the space between the circles may, for example, contain image light emitters 101A-n. In another alternative, the grid structure may be formed with a combinations of shapes, e.g., circles and triangles, squares or triangles, or ovals and circles, or the like, that may be configured to provide the image display and general illumination lighting described with reference to the examples.

The grid structure 117 is a supporting grid of rows and columns with intersection points 119 and transparent sections 115. The individual structural members extend from a first intersection point to a second intersection point. The individual structural members such as 121H and 121V may be portions, or parts, of an entire structural member, for example, that forms a side of grid structure 117. As such, portions of structural members, such as individual (horizontal) structure member 121H and individual (vertical) structure member 121V and at least one other structure member, meet at individual grid structure intersection points, such as 119 to form walls 124 of the grid structure transparent sections 115. The walls 124 (formed from one or more of 121H and 121V) form a perimeter of the individual transparent sections 115. Each individual grid structure transparent section 115 may, for example, share two or more structural members with an adjacent grid structure transparent section 155.

Each of the general illumination light sources 130 of the luminaire 100 may have one or more general illumination light emitters, such as 120, provided as part of the respective general illumination light source 130. Each of the general illumination light emitters 135 may be positioned to output general illumination light through a corresponding individual transparent section, such as 115 or 155, and out a grid structure opening, such as 116, for illumination of a space in which the luminaire 100 is intended to provide general illumination lighting.

Each of the general illumination light sources 130 of the luminaire 100 may also have one or more optics forming a transparent optical coupling 120. Each optical coupling 120 may be configured to direct general illumination light emitted by the general illumination light emitter 135 via an optical output interface in a narrow beam shape that has a first light distribution angle (which will be described in more detail with reference to another figure). While the optical coupling 120 is shown as circular in FIG. 1, the optical coupling 120 may be of any shape. For example, the optical coupling 120 may be any polygonal shape, such as square, rectangular, hexagonal or the like, and may have sharp corners or rounded corners, or may be oval-shaped. In addition, while individual general illumination light sources 130 with their associated optical couplings 120 are shown as being aligned with an individual transparent sections 115, the individual general illumination light sources 130 with their associated optical couplings 120 may be aligned to emit general illumination light from multiple transparent sections 115. Therefore, an individual optical coupling 120 may span multiple transparent sections 115 and the GI light emitted by the respective individual GI light source 130 may pass through the multiple transparent sections 115 into the space to be illuminated.

In order to provide an image display function, the luminaire 100 also includes a number of image light emitters 101A-n supported by the grid structure 117. The grid structure 117 together with the image light emitters 101A-n may thought of as a partially transparent display. The individual image light emitters 101A-n may be light emitting diodes (LEDs) configured to output red, green and blue (RGB) and optionally, white light (RGBW). Alternatively, the individual image light emitters 101A-n may be dual light emitters or the like. Each image light emitter of the number of image light emitters 101A-n may be located at one of the individual grid structure intersection points (e.g., 119). Organic or inorganic LEDs may be used. Other electronically driven light emitters may be used to implement the image light emitter 101A-n. Each image light emitter, such as 101A, 101*n*-1 and 101*n*, may be configured to emit image light that forms a pixel of an output image. The image light may, for example, be output in a wide beam shape having a second light distribution angle (described in more detail with reference to another figure). In an example, the second light distribution angle is greater than the first light distribution angle.

In the example of FIG. 1, each image light emitters 101A-n occupies a corner of a square transparent section 115 or 155 in the grid structure 117. In addition or alternatively, image light emitters may be positioned at other locations along the grid structure 117 such as a center of a side of the transparent sections 115 that form the grid structure 117 as opposed to the intersection points 119. The individual image light emitters, such 101A, 101*n*-1 and 101*n*, of the number of image light emitters 101A-n may be individually controllable via the second circuit path 147. For example, the respective intersection points 119 of the grid structure 117 may be coupled to a driver of a host processor system (shown in another example) via the circuit path 147.

While the above discussion was at a high level, the following discussion will explain a number of different examples with regard to the various aspects of the general illumination light source 130 including the general illumination light emitter 135 and the optical coupling 120 with reference to the examples depicted in FIGS. 2-6.

Figure 2:
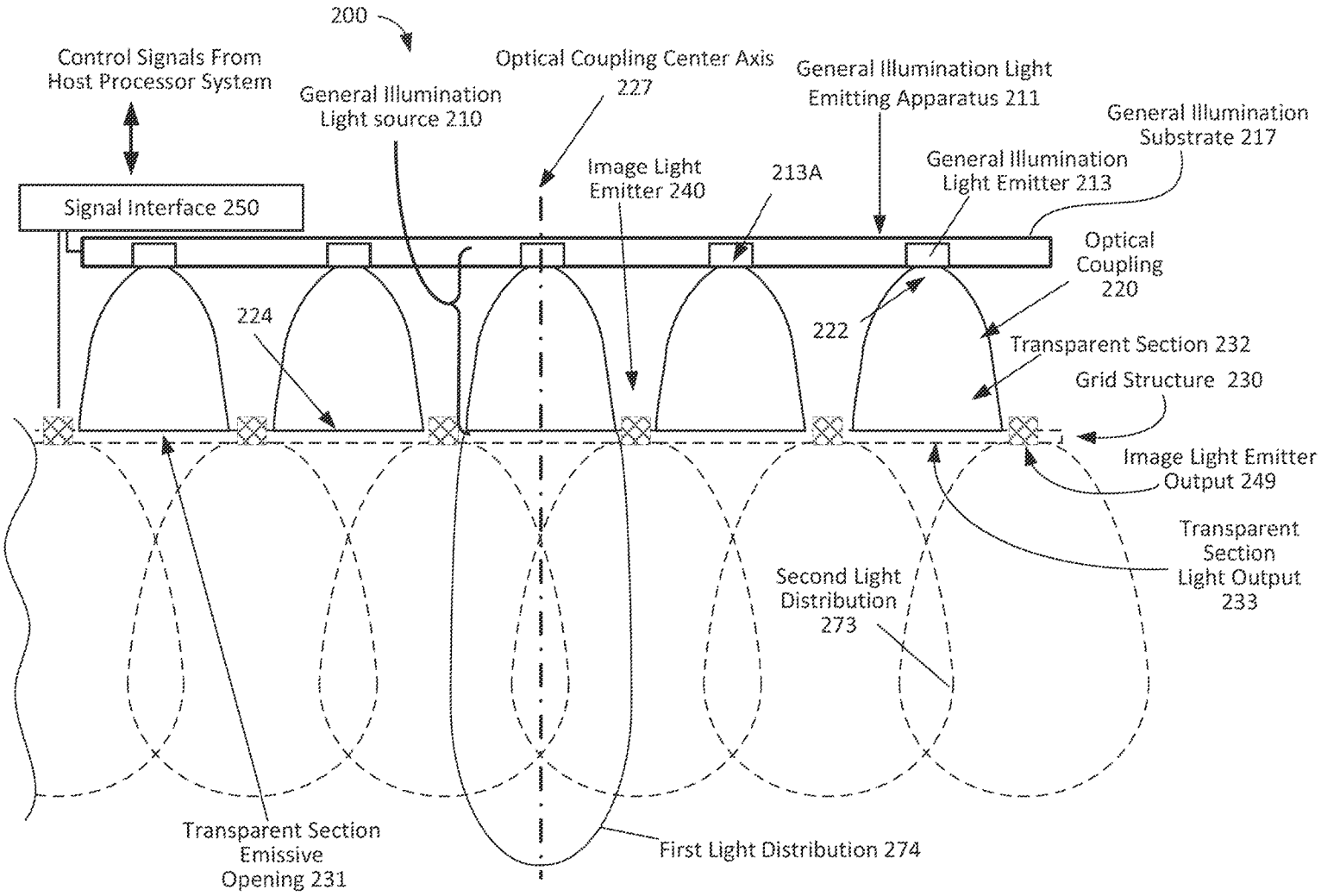
FIG. 2 illustrates a cross-sectional view of an example of a luminaire such as the example shown in FIG. 1.

FIG. 2 illustrates a cross-sectional view of an example of a luminaire 200 configured to display an image and emit general illumination light simultaneously from the grid structure. The luminaire 200 includes a general illumination light emitting apparatus 211, optical couplings 220, a grid structure 230, a set of image light emitters 240 and a signal interface 250.

The general illumination light emitting apparatus 211 includes a set of general illumination light sources 210, and an general illumination substrate 217. The set of general illumination light sources 210 may emit general illumination light for illuminating a space. For example, each general illumination light source 210 in the set of general illumination light sources may include a general illumination light emitter 213, and a transparent optical coupling 220. The general illumination light emitter 213 may be an LED as described above. The general illumination light emitter 213 may have an output surface 213A from which general illumination light produced by emitter is output toward the optical coupling 220. The general illumination light emitter 213 may be configured to output general illumination light from the output surface. The general illumination substrate 217, for example, provides support and/or alignment for the set of general illumination light emitters 213.

The transparent optical coupling 220 may collimate the general illumination light output from the output surface 213A of the general illumination light emitter 213. The transparent optical coupling 220 may have an optical input interface 222 and an optical output interface 224. The optical output interface 222 may be aligned along a center axis, such as 227 with the output surface 213A of the general illumination light emitter 213. The general illumination light emitted by the general illumination light emitter 213 is output via the output surface 213A toward the optical input interface 222 of the optical coupling 220. The spatial distribution of the general illumination light output from the optical output interface 224 has a predetermined beam shape and beam direction. For example, the optical coupling 220 may be a total internal reflection having predetermined optical properties that manipulate the light emitted by the general illumination light emitters 213 to output the light according to the predetermined beam shape and beam direction. As a result of the predetermined beam shape and beam direction of the optical coupling 220, the general illumination light output from the optical coupling 220 may have a narrow beam of general illumination light having a beam direction parallel to the center axis 227 or at 0 degrees. However, in the general illumination light may have a first spatial distribution angle of approximately 20 degrees from the center axis of the general light emitter 213. In this example, the optical parameters of the optical coupling 220 are fixed, and as a result, the first spatial distribution may be fixed as a narrow beam with a first light distribution angle such as the previously mentioned 20°, but may have other distribution angles, such as approximately 10°, 15°, 17°, 25°, 35°, 45° or the like.

In addition to providing general illumination light, such as task lighting, accent lighting (e.g., wall wash or spot lighting for area emphasis, or similar lighting), or the like, the luminaire 200 also presents an image for display to a viewer. The image may be a graphic, such as an advertisement, a logo, a character, an animation or a scene, such as clouds, a person or the like. The pixels of the image may be the result of image light output by a set of image light emitters, which may be configured as a pixel matrix.

In the example of FIG. 2, each of the image light emitters 240 in the set of image light emitters is located, for example, at one of the individual grid structure intersection points, e.g. 119 of FIG. 1. Each of the image light emitters 240 may also be configured to emit image light forming a pixel of an image, the image light output from an image light emitter output 249. The emitted image light may have a wide beam shape as compared to the narrow beam shape of the general illumination light. The wide beam shape may have an image light distribution that has a second light distribution angle 273 that overlaps image light emitted by an adjacent image light emitter to display an image. The image light distribution angle 273 is wider than the distribution angle (i.e., first distribution angle 274) of the general illumination light.

The general illumination emitters 213 and the image light emitters 240 are controlled via signals received from the signal interface 250. The signal interface 250 may be coupled to a driver circuit or host processor system (both described in more detail with reference to another example). For example, the signal interface 250 may deliver intensity information to the respective general illumination emitters 213 based on a general illumination configuration data accessible by the driver circuit or host processor system. Similarly, the signal interface 250 may deliver image related signals to the image light emitters 240 for output of image light according to image data obtained by a host processor system or the driver circuit for display of an image based on the image data.

The grid structure 230 may be configured to maintain the general illumination light sources 210 and the image light emitters 240 in a spaced arrangement relative one another. Similar to the grid structure of FIG. 1, the grid structure 230 includes transparent section 232 that has a transparent section emissive opening 231 at one end of the transparent section 232 closest to the general illumination light emitter 213 and another opening, a transparent section light output 233, opposite the transparent section emissive opening 231. The optical coupling 220 may be inserted into the transparent section 232 via the transparent section emissive opening 231, and light output from the optical coupling 220 may be passed into the space via the transparent section light output 233. The image light emitters 240 may be located at the intersection points, such as 119 of FIG. 1, of the structural members of the grid structure 230.

The transparent optical coupling 220 in this example is a static optical coupling, which means that the optical properties, such as the collimating effects of the optical coupling are preset and may not be changed to vary the spatial properties (e.g., beam shape or beam steering direction) of the light output from the optical coupling 220. In this example, the transparent optical coupling 220 may be one of a total internal reflection lens, a specular reflector, a conical reflector or a parabolic reflector. When referring to the transparent optical coupling 220, it is understood that the transparent optical coupling 220 is transparent to light emitted by the general illumination light sources 210. In addition, the transparent optical coupling may have one or more exterior surfaces (such as surfaces facing other optical couplings and the like, that are light absorbing, such as black-colored surfaces) to prevent stray light from the respective general illumination light sources 210 from interfering with light in an adjacent transparent section, such as 232. In the reflector examples, the exterior surface facing toward the interior of the optical coupling 220 may be reflective to direct light into the optical coupling 220. In other examples, the transparent optical coupling 220 may be a dynamic optical coupling such as a spatial modulator. Examples of spatial modulators include an electrowetting cell, and a liquid crystal polarization grating. The optical properties of respective spatial modulators may be changed by application of a control signal from a driver circuit or the like. Examples that include spatial modulators will be described in more detail with reference to FIGS. 3-5.

In the example of FIG. 2, each optical coupling 220 may have an optical input interface 222 and an optical output interface 224. The optical input interface 222 may be positioned to receive light from the output surface 213A of a respective one of general illumination light emitters 213. The optical output interface 224 may be opposite the optical input interface 222, and may be configured to output general illumination light received from the output surface 213A of a respective general illumination light emitter 213. The general illumination light for illuminating the space is output from the optical output interface 224 corresponding to the respective general illumination light emitter, such as 213 through an individual transparent section, such as 232, of the grid structure 230. In the example of FIG. 2, the transparent optical coupling 220 may be configured to direct the general illumination light in a direction substantially parallel to the center axis of the transparent optical coupling 220. Each optical coupling 220 may be configured to direct general illumination light emitted via the optical output interface 224 in a narrow beam shape having a first light distribution angle 274. In an example, the angle of the first light distribution 274, which is the general illumination light distribution, is less than or equal to approximately 20° with respect to the center axis 227. The second distribution angle 273, which is the image light distribution from image light emitter 240, is, for example, greater than approximately 45° with respect to the center axis 227. In another example, the transparent optical coupling 220 may also be configured to output general illumination light from the optical output interface 224 having a beam shape of less than approximately 20° that offset from the center axis 227 at predetermined angle depending upon the lighting application for a particular space (e.g., a wall wash, spot lighting, etc.). For example, the narrow beam of general illumination light may have a beam direction at approximately 35° or greater (offset from the center axis 227) from the optical output 224 of the transparent optical coupling 220. Since the transparent optical coupling 220 is a static optic, the transparent optical coupling 220 may be preconfigured to provide the beam shape and/or beam direction necessary for an intended lighting application of a space.

Figure 3:
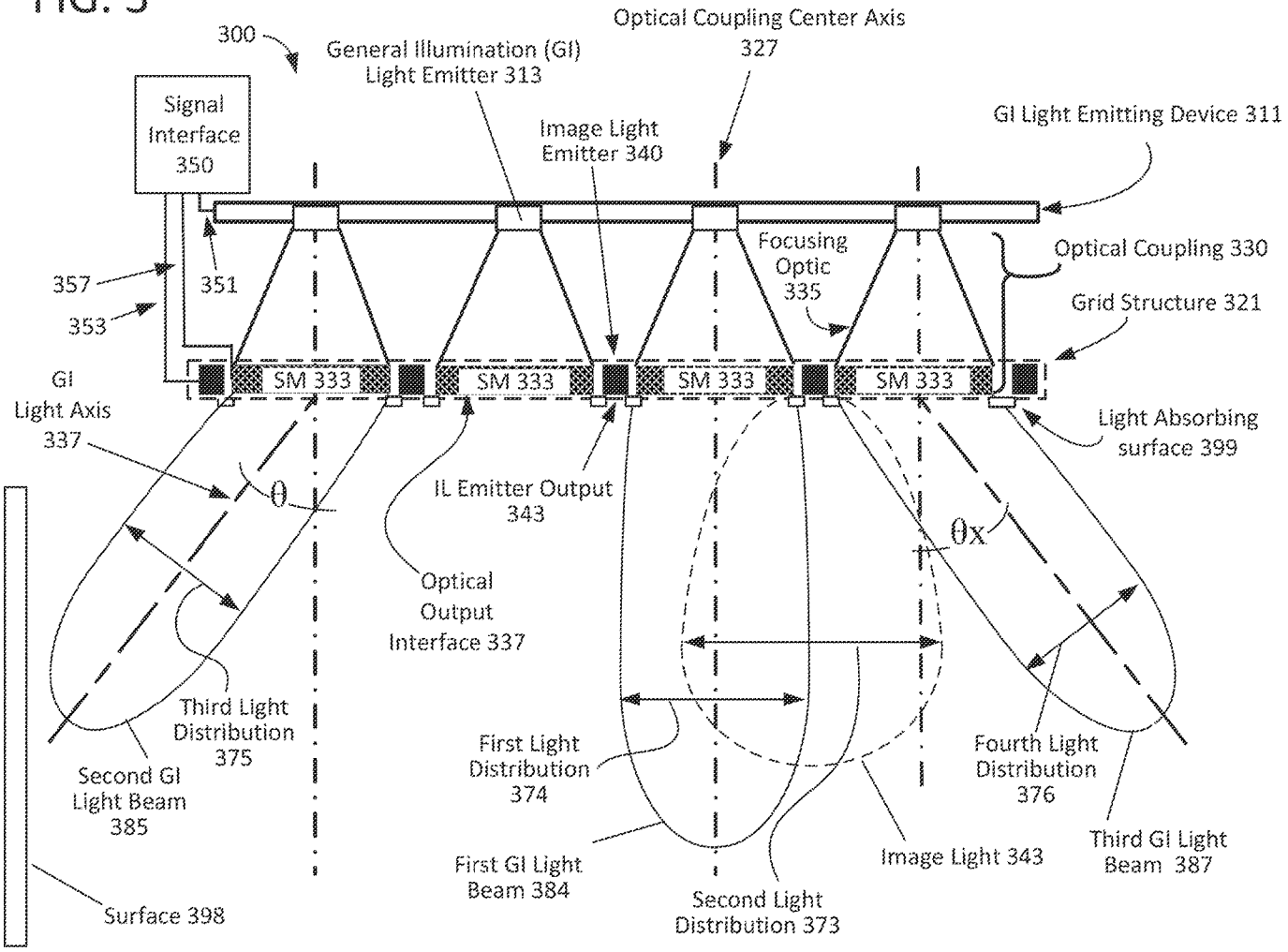
FIG. 3 illustrates a cross-sectional view of another example of a luminaire such as the example shown in FIG. 1.

Another cross-sectional image of a transparent optical coupling is shown in FIG. 3. FIG. 3 illustrates a cross-sectional view of another example of a luminaire such as the example shown in FIG. 1. The luminaire 300 may include features and elements similar to those shown in FIGS. 1 and 2; however, for ease of discussion and illustration, some of the features and elements having similar structure and/or functions have been omitted.

The luminaire 300 includes a general illumination light emitting device 311, an optical coupling 330, a grid structure and a number of image light emitters 340. The luminaire 300 is coupled to a signal interface 350.

The general illumination emitters 313 and the image light emitters 340 are controlled via signals received from the signal interface 350. The signal interface 350 may be coupled to a driver circuit or host processor system (both described in more detail with reference to another example). The signal interface 350 may be configured to receive control signals from a device, such as a driver circuit or host processor system. The received control signals may be intended to control respective general illumination (GI) light emitters 313, image light emitters 340, and/or spatial modulators 333 of the optical coupling 330. The signal interface 350 delivers the control signals to the respective emitters or spatial modulators via the circuit paths 351, 353 and 357 (e.g., first, second, and third circuit paths). Each of the respective GI light emitters 313, image light emitters 340 and spatial modulators 333 may be individually controlled. Alternatively or in addition, a subset or all of the respective GI light emitters 313, image light emitters 340 and spatial modulators 333 may be controlled in unison. For example, each of the spatial modulators 333 may individually direct GI light in different directions or the same direction, or may be controlled in unison to cooperate in directing the GI light in a particular direction, a particular beam shape. In addition or separately, the signal interface 350 may deliver intensity signals or other light characteristic signals (e.g., color, dimming or the like) via circuit path 351 to the respective general illumination emitters 313 based on a general illumination configuration data accessible by the driver circuit or host processor system. Similarly, the signal interface 350 may deliver image related signals (via circuit path 353) to the image light emitters 340 for output of image light according to image data (described in more detail with reference to another example) obtained by a host processor system or the driver circuit for display of an image based on the image data.

The transparent optical coupling 330 may include a focusing optic 335 and a controllable spatial modulator 333. The focusing optic 335 may be configured to receive and direct the general illumination light output from the general illumination (GI) light emitter 313. The controllable spatial modulator 333 is positioned to receive the GI light output from the focusing optic 335. Examples of controllable spatial modulator 333 include electrowetting devices, liquid crystal display polarization gratings or the like. The focusing optic 335 may be a solid optic, such as a TIR optic, or an air-filled optic, such as specular reflector, a conical reflector, or pyramidal reflector, or some other optic that collimates the GI light emitted by the GI emitter 313, or reflects the GI light emitted by the GI emitter 313 toward the controllable spatial modulator 333. The controllable spatial modulator 333, in this example, may be positioned proximate to the focusing optic 335 to receive the GI light directed by the focusing optic 335. The controllable spatial modulator 333 may also be configured to, in response to control signals received from the signal interface 350 via circuit path 357, alter at least one of a beam shape and a beam steering direction of the received general illumination light to provide altered general illumination light. The general illumination light with an altered shape and/or direction is output from the optical output interface 337 of the transparent optical coupling 330.

FIG. 3 illustrates only three examples of the many different beam shaping and/or beam steering states of the general illumination (GI) light beams that may be possible utilizing spatial modulators 333. The GI light emitted from optical interfaces 337 may be processed by the spatial modulators to provide different beam shapes and beam steering directions. In an example of a first state (of the many possible states), the spatial modulator 333 may respond to control signals received from the signal interface 350 (or a lack of control signals) to direct the GI light downward and substantially parallel to the optical coupling center axis 327 with a first light distribution 374. The first GI light beam 384 may have a first light distribution 374 that has a light distribution angle of less than or equal to approximately 20° from the center axis 327.

In response to control signals received from the signal interface 350 via circuit path 357 indicating another state, the spatial modulator 333 of the transparent optical coupling 330 may be configured to direct a beam of light, such as second GI light beam 385, toward a surface 398, such as a wall, work surface, sign, door, entrance way, or the like, associated with the space being illuminated. The directed GI light beam 385 may have a third light distribution 375 that has light distribution angle θ from a center of GI light axis 33, which is also the center of the beam shape of the GI light. In an example, the light distribution angle may be approximately less than or equal to 20°. The second directed general illumination (GI) light state 384 output from the optical coupling output interface, such as 337, may have a beam steering direction that is, for example, θ degrees offset from the optical coupling center axis 327 of the respective general illumination light beam. The beam steering direction angle θ degrees may be, for example, between 35 degrees and 80 degrees offset from the optical coupling center axis 327.

The luminaire 300 also includes a set of image light emitters 340 for generating pixels to display an image. Each of the image light emitters 340 is configured to emit image light from an image light (IL) emitter output 343. The emitted image light may have an image light distribution, such as second light distribution 373, that overlaps image light emitted by an adjacent image light emitter to display an image. The image light distribution 373 is wider than the general illumination light distribution 374, which is also referred to as the first GI light distribution.

The grid structure 321 of the example FIG. 3 may also include an external light absorbing surface 399 to block incident scattered light from an adjacent transparent section. The grid structure 321 may have adhered to grid structure portions an external light absorbing surface 399. The external light absorbing surface 399 may, for example, be coated with black paint, black light-absorbing tar paper and/or black foam. For ease of discussion, the external light absorbing surface 399 is shown only in the example of FIG. 3, but may be incorporated in the other examples, such as those shown in FIGS. 2, 4 and 5.

Figure 4:
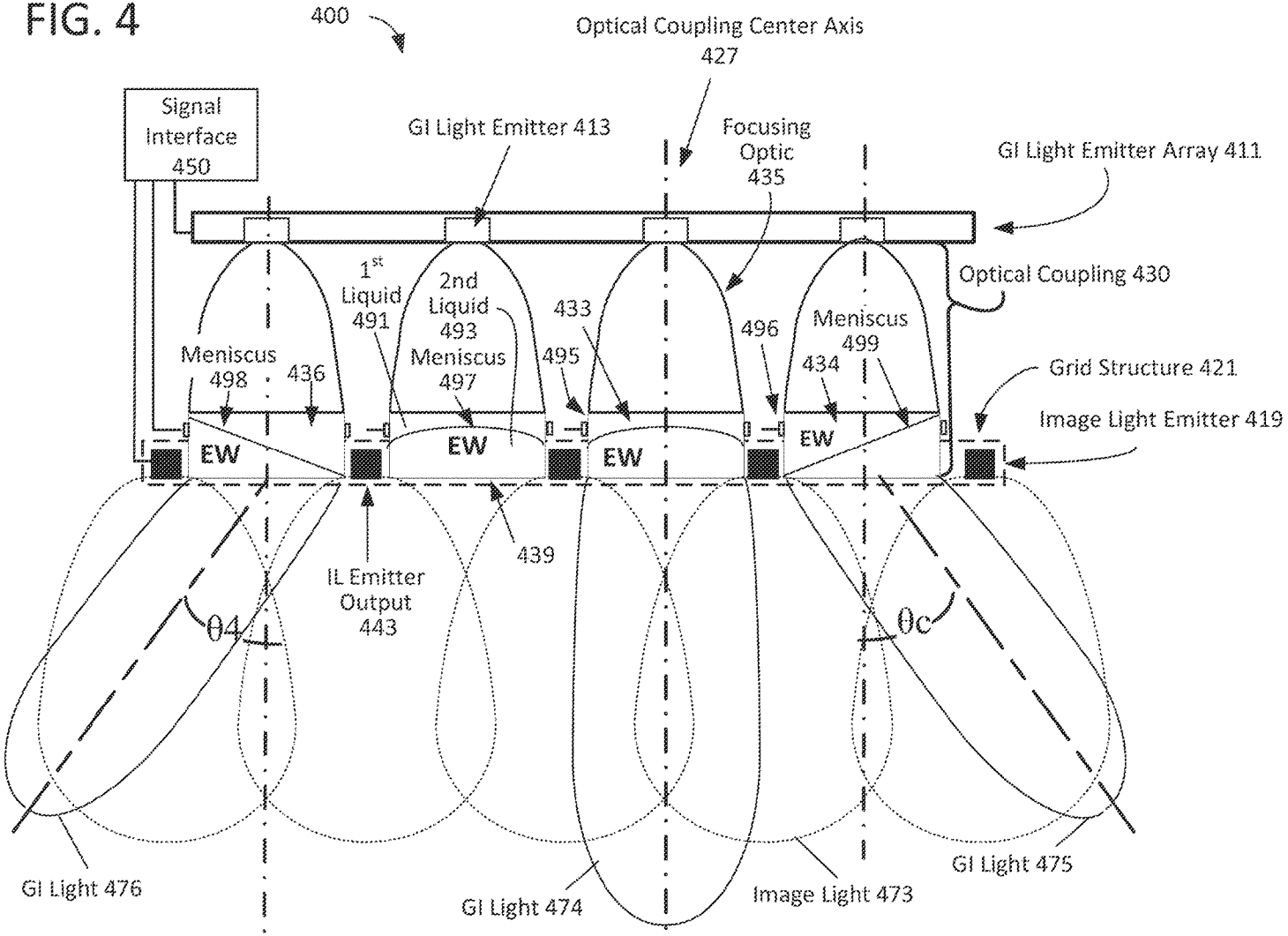
FIG. 4 illustrates a cross-sectional view of yet another example of a luminaire that incorporates an optical coupling as well as an electrowetting cell coupled to each general illumination light emitter.

FIG. 4 illustrates a cross-sectional view of yet another example of a luminaire that incorporates an optical coupling as well as an electrowetting cell coupled to each general illumination light emitter.

The luminaire 400 includes substantially the same components as the luminaire of FIG. 3; therefore, a detailed description of the components with similar structure and function will not be described in detail, but with reference to like elements in FIGS. 2 and 3. For example, the luminaire 400 includes a signal interface 450, an optical coupling 430, a general illumination (GI) light device array 411, a set of image light emitters 419 and grid structure 421. Unless otherwise noted, the GI light device array 411, the set of image light emitters 419 and the grid structure 421 are structurally and functionally substantially the same as those described above with reference to FIGS. 1-3. In the example of FIG. 4, the luminaire 400 includes an example of an electrowetting cell 433 as the spatial modulator 333 shown in FIG. 3. For example, the GI light emitting array 411 includes a set of GI light emitters 413 that are individually controllable by signals received via circuit path 451 from the signal interface 450. The respective image light emitters 419 are similar to the image light emitters 340, and output image light 473.

The signal interface 450 may be similar in function and configuration to the signal interface 350 of FIG. 3 as described above. However, instead of delivering spatial modulator-specific signals to control the spatial modulators 333, the signal interface 450 delivers electrowetting signals to control the respective electrowetting EW cells 434. Examples of the EW cells' responses to the different electrowetting signals will be described in further detail below.

The optical coupling 430 may be configured to receive GL light emitted by the GI light emitter 413 as described with reference to FIGS. 2 and 3. Therefore, a detailed discussion of the configuration details that were discussed with reference to previous examples will be omitted. In the example of FIG. 4, the optical coupling 430 includes a focusing optic 435, and a controllable electrowetting (EW) assembly, such as 433. The focusing optic 435, in this example, may be a lens of a transparent material having a set index of refraction, such as a TIR lens. Examples of TIR lens are formed from solid transparent materials. Alternatively, the focusing optic 435 instead of being formed from a solid transparent material may be an air-filled reflective optic, such as a parabolic or conical reflector.

The controllable electrowetting assembly, such as 433, may be positioned beneath the focusing optic 435 to receive light output from the focusing optic 435. The controllable electrowetting optic 433 may output general illumination light having an altered beam shape and/or beam direction based on the configuration of the controllable electrowetting assembly 433. The controllable electrowetting assembly 433, for example, is coupled to the signal interface 450 and configured to respond to electrowetting signals output by a signal interface 450. As explained in further detail below, the configuration of the controllable electrowetting assembly 433 may, for example, be altered in response to electrowetting signals output by a signal interface 450.

The controllable electrowetting assembly 433 includes a sealed container wall 495 that forms a fluidic sealed cell. Contained within the fluidic sealed cell of the sealed electrowetting cell 434 are a first liquid 491 and a second liquid 493. The first liquid 491 is a high index of refraction liquid and the second liquid 493 is a low index of refraction liquid. A meniscus 497 is present at the interface between the first liquid 491 and the second liquid 493 is. Of the first liquid 491 and the second liquid 493, one of the liquids may be conductive and the other of the liquids may be an insulator. The electrowetting cell 434 also includes electrodes, generally shown as 496 that are coupled to the signal interface 450 and electrically coupled with at least the low index of refraction liquid, e.g., 491. In this example, the low index of refraction liquid 491 may be responsive to the electrowetting signals output from the signal interface, to vary an angle of the meniscus 497 between the high index of refraction liquid 493 and the low index of refraction liquid 491 causing refraction of the general illumination light thereby varying a direction and/or shape of light output via the transparent optical coupling output 439.

It may be appropriate at this time to discuss an operational example of the electrowetting cell 4334 in the example of FIG. 4. As mentioned above, in this example, the electrowetting cells 433, 434 and 436 may be individually controllable and responsive to individual electrowetting signals received from the signal interface 450. For example, the electrowetting cell 436 may be configured to, in response to electrowetting signals received from the signal interface 450, to direct the general illumination light 476 in a direction represented by angle θ4. Note that the meniscus 498 is angled to alter the refraction of the general illumination light output from the respective focusing optic, such as 435. The angle θ4 may be relative to the optical coupling center axis 427, and may vary from a few degrees, such as ±3-5, to approximately ±90 degrees.

Similarly, the electrowetting cell 434 may be configured to, in response to electrowetting signals received from the signal interface 450, to direct the general illumination light 475 in a direction represented by angle θc. Note that the meniscus 499 is angled to alter the refraction of the general illumination light output from the respective focusing optic, such as 435. The angle θc may be relative to the optical coupling center axis 427, and may vary from a few degrees, such as ±3-5, to approximately ±90 degrees. Note that while the GI light 475 and 476 is shown directed outwards from the GI light 474 output from the EW cell 433, the electrowetting cells 434 and 436 could be configured with the appropriate electrowetting signals to direct the respective GI light 475 and 476 beams toward the GI light beam 474 output from EW cell 433. This may be based on a desired general illumination configuration desired by a user and/or stored, for example, in a configuration file that may be the basis for the electrowetting signals provided to the signal interface 450. It should be noted that while the GI light beams 474, 475 and 476 are shown as narrow beams, the beam width may also be altered depending upon the electrowetting signals provided by the signal interface 450. A lighting device example describing further details of configuration files is provided with reference to FIG. 6.

Figure 5:
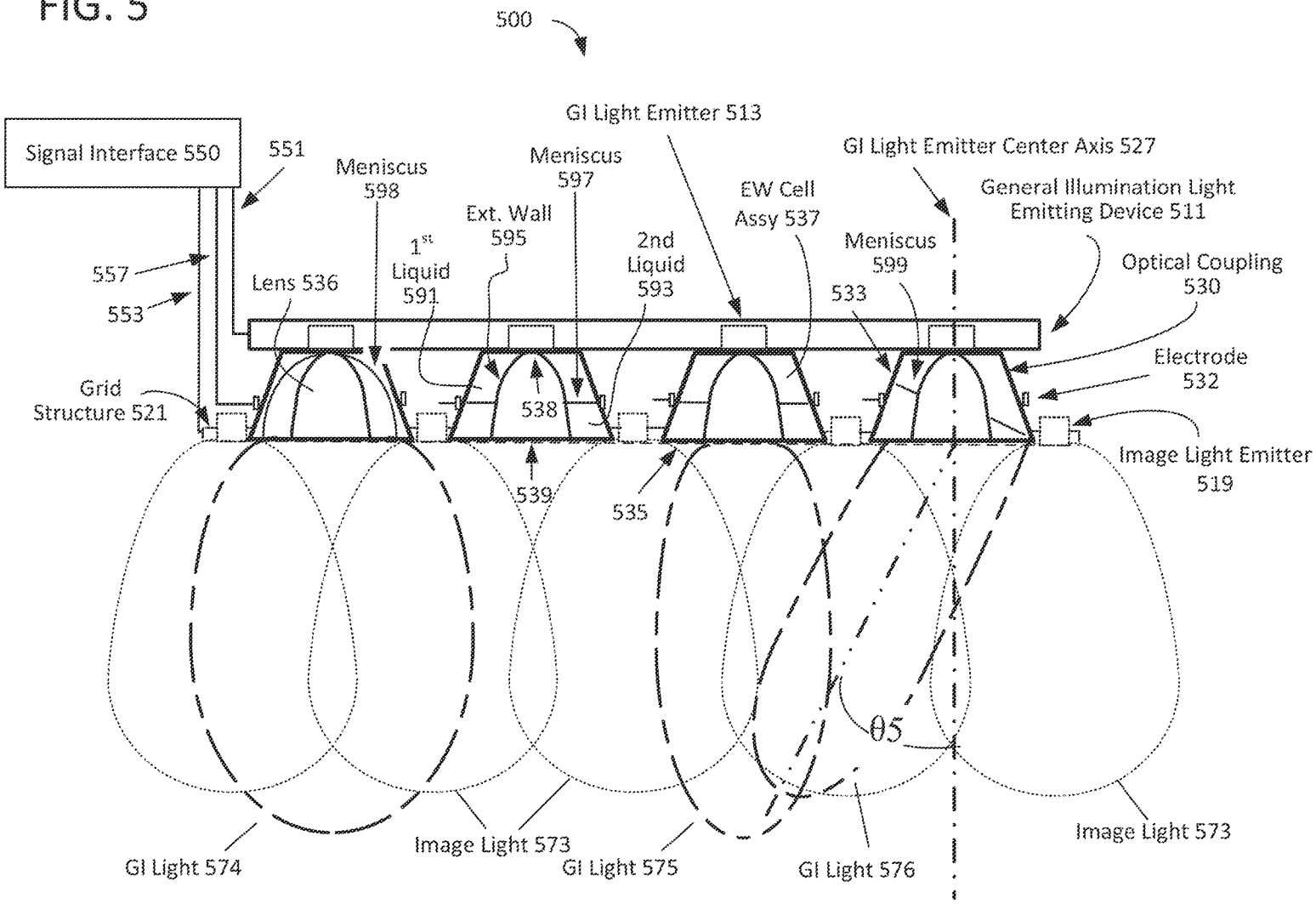
FIG. 5 illustrates a cross-sectional view of yet another example of a luminaire that incorporates another example of an optical coupling.

It is further contemplated that other examples of optical couplings may be used in the luminaries and lighting devices described herein. For example, FIG. 5 illustrates a cross-sectional view of yet another example of a luminaire. In particular, the luminaire 500 in the example of FIG. 5 has an optical coupling 530 that is a combined focusing optic surrounded by an electrowetting cell Like previous examples, a respective optical coupling 530 is coupled to each general illumination light emitter 513.

The luminaire 500 includes substantially the same components as the luminaries of FIGS. 3 and 4; therefore, a detailed description of the components with similar structure and function will not be described in detail, but with reference to like elements in FIGS. 2-4. For example, the luminaire 500 includes a signal interface 550, an optical coupling 530, a general illumination (GI) light emitter array 511, a set of image light emitters 519 and grid structure 521. Unless otherwise noted, the GI light device array 511, the set of image light emitters 519 and the grid structure 521 are structurally and functionally substantially the same as those described above with reference to FIGS. 1-4. For example, the GI light device array 511 includes a set of one or more GI light emitters such as 513. The set of GI light emitters 513 are individually controllable via circuit path 551 by signals received from the signal interface 550. The respective image light emitters 519 may be a set of image light emitters arranged in an array, and are similar to the image light emitters 419 and output image light 573.

The signal interface 550 may be similar in function and configuration to the signal interface 350 of FIG. 3 or 450 of FIG. 4 as described above. However, instead of delivering spatial modulator-specific signals to control the spatial modulators 333, the signal interface 550 delivers electrowetting signals similar to those provided to luminaire 500 to control the respective electrowetting EW cells 537. Examples of the EW cells' responses to the different electrowetting signals will be described in further detail below.

The optical coupling 530 may be configured to receive GI light emitted by the GI light emitter 513 in substantially the same manner as described with reference to the GI light emitters of FIGS. 1-4. Therefore, a detailed discussion of the configuration details that were discussed with reference to previous examples will be omitted.

The optical coupling 530 of the example of FIG. 5 includes a lens 536 and a controllable electrowetting assembly 537. The lens 536 may be formed from a transparent material having a set index of refraction. The lens 536 has a transparent exterior lens wall extending from the optical input interface 538 to the optical output interface 539 of the optical coupling 530. The controllable electrowetting assembly 537 may, for example, surround the transparent lens 536 forming a fluidic sealed cell with the exterior wall surrounding the transparent lens 536. The controllable electrowetting assembly 537 is coupled to the signal interface 550, and is configured to respond to electrowetting signals output by the signal interface 550.

In more detail, the controllable electrowetting assembly includes a sealed container wall 533 and electrodes 532. The sealed container wall 533 includes at least one wall spaced about the transparent lens 536. The fluidically sealed cell formed by the sealed container wall 533 contains a high index of refraction liquid 591 and a low index of refraction liquid 593. One of the liquids 591 or 593 is conductive and the other of the liquids is an insulator. For example, one of the liquids (e.g., the conductive fluid) may be water and the other may be an oil (e.g., the insulator). The controllable electrowetting assembly 530 also includes an electrowetting optical aperture 535 surrounding and extending outward from the optical output interface 539. The controllable electrowetting assembly receives electrowetting signals via electrodes 532 coupled to the signal interface 550 and electrically coupled with at least the low index of refraction liquid 593. The low index of refraction liquid 593 is responsive to the electrowetting signals output from the signal interface 550, to vary the amount of the exterior wall 595 of the transparent lens 536 covered by the low index of refraction liquid 593 to cause total internal reflection of light within the transparent lens 536. As a result of the variation in the amount of low index of refraction liquid 593 covering the exterior wall 595, a direction and/or shape of light output via the electrowetting optical aperture 535 and/or the optical output interface 539 is controlled.

An example of a combined lens and a controllable electrowetting assembly is described in more detail in U.S. application Ser. No. 15/188,195 entitled, "Variable Total Internal Reflection Electrowetting Lens Assembly," which was filed on Jun. 21, 2016 and assigned to the present Applicant. The entire contents of U.S. application Ser. No. 15/188,195 are incorporated herein by reference.

Figure 6:
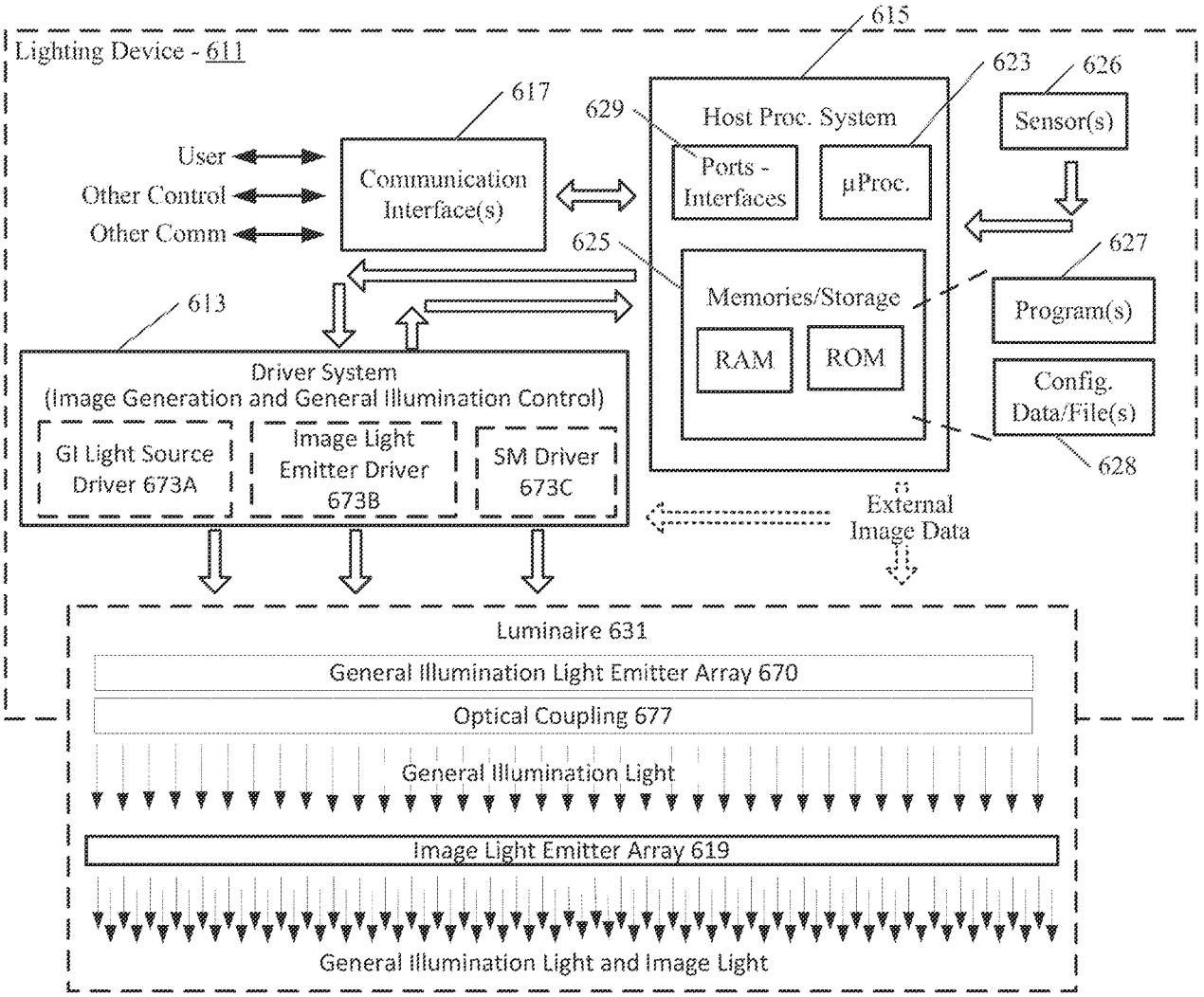
FIG. 6 is a high-level functional block diagram of an example of a lighting device incorporating a luminaire such as one shown in the respective examples described with reference to FIGS. 1-5.

It may be appropriate now to describe an example in which one of the luminaire examples of FIGS. 1-5 is implemented in a lighting device. FIG. 6 is a high-level functional block diagram of an example of a lighting device incorporating a luminaire such as the examples described with reference to FIGS. 1-5. FIG. 6 is a stylized view of a controllable lighting device depicting a relationship between an image light emitter array 619 and a general illumination light emitter array 670 in a luminaire 631 of the type under consideration here that is configurable for illumination of a space and for displaying an image in the space.

For illustration and discussion purposes, the luminaire 631 that includes a general illumination light emitter array 670 and a number of transparent optical couplings 677. Each transparent optical coupling 677 includes an optical output interface (not shown in this example) and is coupled to an output of a corresponding one of a general illumination light emitter of the array 670. The optical coupling 677 outputs from the optical output interface a substantial portion of the general illumination light received via an output of the corresponding general illumination light emitter. Each of the transparent optical couplings may include other components for directing and/or shaping the illumination light output of the respective general illumination light emitters such as a controllable spatial modulator as described above with reference to the examples of FIGS. 3-5.

The luminaire 631 of the lighting device 611 also includes an image light emitter array 619. Each image light emitter in the array of image light emitters 619 is controllable via couplings to the host processing system 615 to emit image light for a respective pixel of the image to be displayed. In addition or alternatively, the image data may be provided to the image light emitter array 619 from an external source(s) (not shown), such as a remote server or an external memory device via one or more of the communication interfaces 617. The general illumination light emitter array 670 is configured to generate general illumination light that provides general illumination to the area in which the lighting device 611 is located.

Additional details of all of the components, functions and structures of luminaire 631 may be similar to the respective components, functions and structures described with reference to the examples of FIGS. 1-5, and therefore, a detailed discussion of those respective components, functions and structures has been omitted in the following discussion of FIG. 6.

The functions of elements 670 and 619 (and any spatial modulators, if present) are controlled by the control signals (e.g., illumination emitter drive signals, image light emitter drive signals, and possibly electrowetting signals) received from the driver system 613. The driver system 613 may be an integral unit generating appropriate drive signals for operation of the light emitter array(s) 619, 670 and any other controllable components of the luminaire 631 and of the image light emitter array 619. As illustrated, the driver system 613 may include a general illumination light source driver 673A coupled to provide drive signal(s) to operate the general illumination light emitter(s) of the general illumination light emitter array 670 and a separate image light emitter driver 673B to provide drive signals to operate the image light emitter array 619. The controllable general illumination light source driver 673A may provide signals to control the actual emitter component(s) of the general illumination light emitter array 670 in response to control signals from the host processing system 615. The image light emitter driver 673B may receive image signals from the image light emitter driver 673B based on control signals or image data from host processing system 615. Similarly, a (controllable) spatial modulator (SM) driver 673C may output signals to control the components of the optical coupling 677, such as a modulator, under control of the host processing system 615.

Light from the emitters(s) 670 and any optics, such as 677, forming the luminaire 631 alone or in combination with image output light from the image light emitter array 619 provides general illumination lighting that complies with governmental building codes and/or industry lighting standards, such as Occupational safety and Health Administration (OSHA), Illuminating Engineering Society (IES) and American National Standards Institute (ANSI) standards for providing lighting for a stated purpose within the space, such as task lighting, reading light, exit illumination or the like. The image light emitter array 619, in the example, is located proximate to the general illumination light emitting array 670 as described in previous examples. The image light emitter array 619 is configured to output image light representing a low-resolution image to be presented to the area in which the luminaire 631 is illuminating. The presented image may be a real scene, a computer generated scene, a single color, a collage of colors, a video stream, animation or the like. The controllable general illumination light emitter array 670 of luminaire 631 may be an otherwise standard general illumination system, which is co-located with the image light emitter array 619, and that includes one or more light emitters that provide general illumination that satisfies the governmental building codes and/or industry lighting standards.

As shown in FIG. 6, the example of the lighting device 611 includes a host processing system 615, one or more sensors 626 and one or more communication interface(s) 617.

The host processing system 615 provides the high level logic or "brain" of the lighting device 611. The host processing system 615 upon execution of programming code may be configured to perform the functions of processor 623, such as those described above with reference to FIGS. 2-5. In the example of FIG. 6, the host processing system 615 includes data storage/memories 625, such as a random access memory and/or a read-only memory, as well as programs 627 stored in one or more of the data storage/memories 625. The programs 627 may include image processing programs that enable the host processing system 615 to perform the resizing and down-sampling described above. The data storage/memories 625 store various data, including information about the image light emitter array 619 lighting device configuration/image data/files 628 or one or more configuration/image data files containing such information, in addition to the illustrated programming 627. The image files 628 may be an image source from which the host processing system 615 obtains image data for presentation as a low-resolution image output from the image light emitter array 619. The host processing system 615 also includes a central processing unit (CPU), shown by way of example as a microprocessor (μP) 623, although other processor hardware may serve as the CPU.

The ports and/or interfaces 629 couple the processor 623 to various elements of the device 611 logically outside the host processing system 615, such as the driver system 613, the communication interface(s) 617 and the sensor(s) 626. For example, the processor 623 by accessing programming 627 in the memory 625 controls operation of the driver system 613 and other operations of the lighting device 611 via one or more of the ports and/or interfaces 629. In a similar fashion, one or more of the ports and/or interfaces 629 enable the processor 623 of the host processing system 615 to use and communicate externally via the interface(s) 617; and the one or more of the ports 629 enable the processor 623 of the host processing system 615 to receive data regarding any condition detected by a sensor 626, for further processing.

In the operational examples, based on its programming 627, the processor 623 processes data retrieved from the memory 623 and/or other data storage, and responds to light output parameters in the retrieved data to control the illumination and image light generation and optionally the light distribution from luminaire 631. The light output control also may be responsive to sensor data from a sensor 626. The light output parameters may include light intensity and light color characteristics of light from light emitter array 670 in addition to spatial distribution control via an optical coupling 677 equipped with a spatial modulator (e.g. steering and/or shaping and the like for achieving a desired spatial distribution).

As noted, the host processing system 615 is coupled to the communication interface(s) 617. In the example, the communication interface(s) 617 offer a user interface function or communication with hardware elements providing a user interface for the lighting device 611. The communication interface(s) 617 may communicate with other control elements, for example, a host computer of a building control and automation system (BCAS). The communication interface(s) 617 may also support device communication with a variety of other equipment of other parties having access to the lighting device in an overall lighting system, e.g. equipment of the manufacturer of lighting device 611 for maintenance or an on-line server for downloading of programming instruction or configuration data for setting aspects of luminaire operation. The communication interface(s) 617 may also receive images for presentation by the image light emitter array 619. The received images may require transformation as described previously, or may not.

In an example of the operation of the lighting device 611, the processor 623 receives a configuration file 628 via one or more of communication interfaces 617. The processor 623 may store, or cache, the received configuration file 628 in storage/memories 625. In addition to the configuration file 628, the processor 623 may obtain from the storage/memories 625 or a remote device via the communication interfaces 617 an image for display by the image light emitter array 619. A memory 625 may store an image for display by the image light emitter array 619. Alternatively, the configuration file 628 may also include data that indicates, for example, an image for display by the image light emitter array 619 as well as lighting settings for light to be provided by the luminaire 631. Each configuration file may also include one or more general illumination settings to set the light output parameters of the lighting device 611, at least with respect to one or more operational parameters for the controllable general illumination light emitter array 670 and possibly optical/spatial modulation parameters (e.g. regarding angle a shape) for control of the optical coupling 677 spatial modulator, if present.

Using the data indicating the image to be obtained from the storage/memories 625, the processor 623 may retrieve from storage/memories 625 an image for presentation by the image light emitter array 619. The processor 623 delivers the image data to the driver system 613. The driver system 613 may deliver the image data directly to the image light emitter array 619 for presentation or may have to convert the image data into a signal or data format suitable for delivery to the image light emitter array 619. For example, the image data may be video data formatted according to compression formats, such as H.264 (MPEG-4 Part 10), HEVC, Theora, Dirac, RealVideo RV40, VP8, VP9, or the like, and still image data may be formatted according to compression formats such as Portable Network Group (PNG), Joint Photographic Experts Group (JPEG), Tagged Image File Format (TIFF) or exchangeable image file format (Exif) or the like. For example, if floating point precision is needed, options are available, such as OpenEXR, to store 32-bit linear values. In addition, the hypertext transfer protocol (HTTP), which supports compression as a protocol level feature, may also be used.

A controllable lighting device such as 611 may be reconfigured, e.g. to change the image display output and/or to change one or more parameters to the illumination light output by changing the corresponding aspect(s) of the configuration data file 628, by replacing the configuration data file 628, retrieving different image data from memory 625, or by selecting a different file from among a number of such files already stored in the data storage/memories 625.

In other examples, the driver system 613 is coupled to the memory 625, the image light emitter array 619 and the luminaire 631 to control light generated by the image light emitter array 619 and the luminaire 631 based on the configuration data 628 stored in the memory 625. In such an example, the driver system 613 is configured to directly access configuration data 628 stored in the memory 625 and generate control signals for presenting the image on the image light emitter array 619 and control signals for generating light for output from the luminaire 631.

A lighting device 611 may be programmed to transmit information on the light output from the luminaire 631. Examples of information that the device 611 may transmit in this way include a code, e.g. to identify the luminaire 631 and/or the lighting device 611 or to identify the luminaire location within a premises or area. Alternatively or in addition, the light output from the luminaire 631 may carry downstream transmission of communication signaling and/or user data. The data transmission may involve adjusting or modulating parameters (e.g. intensity, color characteristic or distribution) of the general illumination light output of the illumination system 112 or an aspect of the light output from the image light emitter array 619. Transmission from the image light emitter array 619 may involve modulation of the backlighting of the particular type of display device. Another approach to light based data transmission from the image light emitter array 619 may involve inclusion of a code representing data in a portion of a displayed image. The modulation or image coding typically would not be readily apparent to a person in the illuminated area observing the luminaire operations but would be detectable by an appropriate receiver. The information transmitted and the modulation or image coding technique may be defined/controlled by configuration data or the like stored in the memories/storage 625. Alternatively, user data may be received via one of the interfaces 617 and processed in the device 611 to transmit such received user data via light output from the luminaire 631.

Equipment implementing functions like those of configurable lighting device 611 may take various forms. In some examples, some components attributed to the lighting device 611 may be separated from the controllable general illumination light emitter array 670 and image light emitter array 619 of the luminaire 631. For example, a lighting device may have all of the above hardware components on a single hardware device as shown or in different somewhat separate units. In a particular example, one set of the hardware components may be separated from one or more instances of the controllable luminaire 631, such that the host processing system 615 may run several luminaries having displays, illumination light sources and possibly modulators from a remote location. Also, one set of intelligent components, such as the microprocessor 623, may control/drive some number of driver systems 613 and associated controllable luminaries 631. It also is envisioned that some lighting devices may not include or be coupled to all of the illustrated elements, such as the sensor(s) 626 and the communication interface(s) 617.

In addition, the luminaire 631 of each lighting device 611 is not size restricted. For example, each luminaire 631 may be of a standard size, e.g., 2-feet by 2-feet (2×2), 2-feet by 4-feet (2×4), or the like, and arranged like tiles for larger area coverage. Alternatively, one luminaire 100 may be a larger area device that covers a wall, a part of a wall, part of a ceiling, an entire ceiling, or some combination of portions or all of a ceiling and wall.

Lighting equipment like that disclosed in the example of FIG. 6, may have alternate configurations that combine the general illumination light sources with image display device emitters to provide general illumination and image light. The general illumination output from the combined general illumination light sources and image display device emitters for an intended area of a space meets the governmental and/or industry standards, e.g. OSHA, IES, or ANSI, described above for the intended area.

A number of the lighting devices and/or luminaries of any of FIGS. 1-6 may be utilized as components of an overall lighting system. An example of a system utilizing software configurable lighting devices has been described in U.S. patent application Ser. No. 15/198,712, filed Jun. 30, 2016, entitled "Enhancements Of A Transparent Display To Form A Software Configurable Luminaire," the entire contents of which are incorporated herein by reference. U.S. patent application Ser. No. 15/198,712 is assigned to the Applicant of the present application.

Program aspects of the technology discussed above may be thought of as "products" or "articles of manufacture" typically in the form of executable code and/or associated data (software or firmware) that is carried on or embodied in a type of machine readable medium. "Storage" type media include any or all of the tangible memory of the computers, processors or the like, or associated modules thereof, such as various semiconductor memories, tape drives, disk drives and the like, which may provide non-transitory storage at any time for the software or firmware programming. All or portions of the programming may at times be communicated through the Internet or various other telecommunication networks. Such communications, for example, may enable loading of the software from one computer or processor into another, for example, from a management server or host computer of the lighting system service provider into any of the lighting devices, sensors, user interface devices, other non-lighting-system devices, etc. of or coupled to the lighting device and/or luminaire via communication interfaces, such as 617, including both programming for individual element functions and programming for distributed processing functions. Thus, another type of media that may bear the software/firmware program elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible or "storage" media, terms such as computer or machine "readable medium" refer to any medium that participates in providing instructions to a processor for execution.

The term "coupled" as used herein refers to any logical, physical or electrical connection, link or the like by which signals produced by one system element are imparted to another "coupled" element. Unless described otherwise, coupled elements or devices are not necessarily directly connected to one another and may be separated by intermediate components, elements or communication media that may modify, manipulate or carry the signals.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "a" or "an" does not, without further constraints, preclude the existence of additional identical elements in the process, method, article, or apparatus that comprises the element.

Unless otherwise stated, any and all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present concepts.

What is claimed is:

1. A luminaire, comprising:

walls formed by structural members that meet at individual grid structure intersection points, the walls forming a perimeter of individual transparent sections;

a plurality of general illumination light emitters, wherein each of the general illumination light emitters is positioned to output general illumination light toward a corresponding individual transparent section; and a plurality of transparent optical couplings, each optical coupling having:

an optical input interface positioned to receive light from a respective one of the general illumination light emitters, and an optical output interface, opposite the optical input interface, configured to output general illumination light received from a respective general illumination light emitter through the individual transparent section corresponding to the respective general illumination light emitter, each optical coupling being configured to direct general illumination light emitted via the optical output interface in a narrow beam shape having a first light distribution angle;

a plurality of image light emitters, wherein each image light emitter of the plurality of image light emitters is:

located at one of the individual grid structure intersection points, and configured to emit image light forming a pixel of an image, the image light output in a wide beam shape having a second light distribution angle, wherein the second light distribution angle is greater than the first light distribution angle.

2. The luminaire of claim 1, wherein each transparent optical coupling further comprises:

a lens of a transparent material having a set index of refraction, the transparent lens comprising:

a transparent exterior lens wall extending from the optical input interface to the optical output interface; and a controllable electrowetting assembly surrounding the transparent lens, the controllable electrowetting assembly being coupled to a signal interface and configured to respond to electrowetting signals output by the signal interface, the controllable electrowetting assembly comprising:

a sealed container wall including at least one wall spaced about the transparent lens, wherein the sealed container wall forms a fluidic sealed cell with the exterior wall of the transparent lens, a high index of refraction liquid and a low index of refraction liquid contained in the sealed cell, one of the liquids being conductive and the other of the liquids being an insulator, an electrowetting optical aperture surrounding and extending outward from the optical output interface, and electrodes coupled to the signal interface and electrically coupled with at least the low index of refraction liquid, wherein:

the low index of refraction liquid is responsive to the electrowetting signals output from the signal interface, to vary the amount of the exterior wall of the transparent lens covered by the low index of refraction liquid and cause total internal reflection of light within the transparent lens to thereby vary a direction and/or shape of light output via the electrowetting optical aperture and/or the optical output interface.

3. The luminaire of claim 1, wherein each transparent optical coupling further comprises:

a focusing optic, the focusing optic configured to direct general illumination light toward the optical output;

a controllable electrowetting assembly positioned beneath the focusing optic to receive general illumination light output from the focusing optic and output general illumination light having an altered beam shape and/or beam direction, the controllable electrowetting assembly being coupled to a signal interface and configured to respond to electrowetting signals output by a signal interface, the controllable electrowetting assembly comprising:

a sealed container wall forming a fluidic sealed cell, a high index of refraction liquid and a low index of refraction liquid contained in the sealed cell, one of the liquids being conductive and the other of the liquids being an insulator, and electrodes coupled to the signal interface and electrically coupled with at least the low index of refraction liquid, wherein:

the low index of refraction liquid is responsive to the electrowetting signals output from the signal interface, to vary an angle of a meniscus between the high index of refraction liquid and the low index of refraction liquid causing refraction of the general illumination light thereby varying a direction and/or shape of light output via the optical output interface.

4. The luminaire of claim 1, wherein the transparent optical coupling is one of a total internal reflection lens, a specular reflector, a conical reflector or a parabolic reflector.

5. The luminaire of claim 1, wherein:

the general illumination light emitters are coupled to a first circuit path, and the image light emitters are coupled to a second circuit path.

6. The luminaire of claim 1, wherein the number of grid structure intersection points is greater than to the plurality of image light emitters.

7. The luminaire of claim 1, wherein:

the first distribution angle is less than or equal to approximately 20°, and the second distribution angle is greater than approximately 45°.

8. The luminaire of claim 1, wherein the transparent optical coupling is configured to direct the narrow beam toward a wall of the space being illuminated, and the first distribution angle of narrow beam shape is less than approximately 20°.

9. A luminaire, comprising:

a set of general illumination light sources that emit general illumination light for illuminating a space, each general illumination light source in the set of general illumination light sources including:

a general illumination light emitter having an output surface, the general illumination light emitter configured to output general illumination light from the output surface, a transparent optical coupling for collimating the general illumination light output from the output surface of the general illumination light emitter, the transparent optical coupling having an optical output interface, the optical output interface aligned along a center axis with the output surface of the general illumination light emitter, wherein:

the general illumination light output via the optical output interface has a general illumination light distribution according to a predetermined beam shape and beam direction;

a set of image light emitters, each of the image light emitters configured to emit image light from an image light emitter output, wherein:

the emitted image light from each image light emitter has an image light distribution that overlaps image light emitted by an adjacent image light emitter to display an image, and the image light distribution is wider than the general illumination light distribution; and a grid structure configured to maintain the general illumination light sources and the image light emitters in a spaced arrangement relative one another, wherein the luminaire is configured to display the image and emit general illumination light simultaneously from the grid structure.

10. The luminaire of claim 9, wherein:

the transparent optical coupling is configured to direct the general illumination light in a direction substantially parallel to the center axis of the transparent optical coupling, the general illumination light distribution is less than or equal to approximately 20° from the center axis of the transparent optical coupling, and the image light distribution is greater than approximately 45° from an image light emitter.

11. The luminaire of claim 9, wherein the transparent optical coupling is configured to output general illumination light from the optical output interface having a beam direction directed at approximately 35° or greater from the optical output of the transparent optical coupling, and a beam shape of less than 20°.

12. The luminaire of claim 9, wherein the luminaire further comprises:

a signal interface, the signal interface configured to receive control signals from a device coupled to the luminaire;

wherein the transparent optical coupling further includes:

a focusing optic configured to receive and focus the general illumination light output from the general illumination light emitter; and a controllable spatial modulator positioned to receive the focused general illumination light, the controllable spatial modulator configured to:

in response to control signals received from the signal interface, alter at least one of a beam shape and beam direction of the received general illumination light to provide altered general illumination light; and output the altered general illumination light from the optical output of the transparent optical coupling.

13. The luminaire of claim 12, wherein the controllable spatial modulator comprises an electrowetting cell or a liquid crystal polarization grating.

14. The luminaire of claim 12, wherein the focusing optic comprises a total internal reflection optic, pyramidal reflector or a parabolic reflector.

15. The luminaire of claim 9, wherein the grid structure further comprises:

a supporting grid of rows and columns with intersection points and transparent sections, wherein each of the transparent sections is bounded by individual structural members of the grid meeting at individual intersection points.

16. A lighting device comprising:

a luminaire configurable for illumination of a space and for displaying an image in the space, the luminaire including:

an array of general illumination light emitters controllable to emit general illumination light for illuminating the space, wherein each of the general light emitters has an output;

a plurality of transparent optical couplings, each respective transparent optical coupling comprising an optical output interface, and being coupled to the output of a corresponding one of the general illumination light emitters to output general illumination light received from the corresponding general illumination light emitter for output through the optical output interface;

an array of image light emitters configured to display the image, each image light emitter in the array of image light emitters controllable to emit image light for a respective pixel of the image, and a grid structure configured to maintain a spaced arrangement of general illumination light emitters of the array of general illumination light emitters and the image light emitters of the array of image light emitters; and a host processing system coupled to the array of general illumination light emitters and the array of image light emitters, wherein the host processing system includes a processor and a memory coupled for access by the processor, the memory storing:

program instructions for controlling illumination and image display operations of the lighting device, and a configuration file containing general illumination configuration data for controlling the emitted general illumination light;

the processor when executing the program instructions stored in the memory, configures the host processing system to:

obtain image data;

control the array of image light emitters to display the image, based on the obtained image data;

access the general illumination configuration data in the configuration file; and configure the array of general illumination light emitters to emit general illumination light based on the general illumination configuration data, while a portion of or all of the plurality of image light emitters of the luminaire displays the image.

17. The lighting device of claim 16, wherein each transparent optical coupling of the plurality of transparent optical couplings includes:

a signal interface coupled to the host processor, the signal interface configured to receive control signals from a device coupled to the luminaire;

a focusing optic configured to receive and collimate the general illumination light output from the general illumination light emitter; and a controllable spatial modulator positioned proximate to the focusing optic to receive the collimated general illumination light, the controllable spatial modulator configured to:

in response to control signals received from the signal interface, alter at least one of a beam shape and beam direction of the received general illumination light to provide altered general illumination light; and output the altered general illumination light from the optical output of the transparent optical coupling.

18. The lighting device of claim 17, the memory further storing a configuration file containing spatial modulation data usable by the processor for controlling the beam shape and/or beam steering direction of the emitted general illumination light.

19. The lighting device of claim 17, the focusing optic is further configured to:

direct the general illumination light received from the respective general illumination light emitter out an optical output interface of the optical coupling in a narrow beam shape having a general illumination light distribution angle, the general illumination output from the optical output interface illuminating a space in which the luminaire is located.

20. The lighting device of claim 19, wherein:

the general illumination light distribution angle is less than or equal to approximately 20° from the center axis of the transparent optical coupling, and the image light from the array of image light emitters has an image light distribution that is greater than approximately 45° from each of the image light emitters in the pixel matrix.

21. The lighting device of claim 17, wherein each spatial modulator of the array of optical couplings is configured to output general illumination light having a beam steering direction directed at approximately 45° or greater from an optical output of the spatial modulator, and a beam shape of less than 20°.

22. The system of claim 21, wherein the external light absorbing surface is coated with black paint adhered or black absorbing tar paper and includes adhered black foam.

23. The lighting device of claim 16, wherein the grid structure includes an external light absorbing surface to block incident scattered light from an adjacent transparent section.

* * * * *